US010633787B1

(12) United States Patent
Pham

(10) Patent No.: US 10,633,787 B1
(45) Date of Patent: Apr. 28, 2020

(54) TAGS FOR TEMPORARILY CONNECTING TWO ITEMS

(71) Applicant: Eric Giao Pham, San Jose, CA (US)

(72) Inventor: Eric Giao Pham, San Jose, CA (US)

( * ) Notice: Subject to any disclaimer, the term of this patent is extended or adjusted under 35 U.S.C. 154(b) by 15 days.

(21) Appl. No.: 16/007,129

(22) Filed: Jun. 13, 2018

Related U.S. Application Data

(60) Provisional application No. 62/528,976, filed on Jul. 6, 2017.

(51) Int. Cl.

| | |
|---|---|
| ***A41B 11/00*** | (2006.01) |
| ***D06F 95/00*** | (2006.01) |
| *A41D 19/00* | (2006.01) |
| *A41B 11/10* | (2006.01) |
| *A63B 71/12* | (2006.01) |
| *A41B 11/12* | (2006.01) |

(52) U.S. Cl.
CPC ..... *D06F 95/008* (2013.01); *A41B 11/002* (2013.01); *A41B 11/00* (2013.01); *A41B 11/003* (2013.01); *A41B 11/004* (2013.01); *A41B 11/005* (2013.01); *A41B 11/007* (2013.01); *A41B 11/008* (2013.01); *A41B 11/10* (2013.01); *A41B 11/12* (2013.01); *A41B 2300/30* (2013.01); *A41B 2300/32* (2013.01); *A41B 2300/324* (2013.01); *A41D 19/0034* (2013.01); *A41D 2300/324* (2013.01); *A63B 71/12* (2013.01); *A63B 71/1225* (2013.01); *A63B 2071/125* (2013.01); *A63B 2071/1258* (2013.01); *D06F 95/00* (2013.01)

(58) Field of Classification Search
CPC ..... A41B 11/002; A41B 11/10; A41B 11/12; A41B 11/00; A41B 11/003; A41B 11/004; A41B 11/005; A41B 11/007; A41B 11/008; A41B 2300/30; A41B 11/32; A41B 11/324; A41D 19/0034; A41D 2300/324; A63B 71/12; A63B 71/1225; A63B 2071/125; A63B 2071/1258; D06F 95/008; D06F 95/00
USPC ..... 2/239, 409, 912
See application file for complete search history.

(56) References Cited

U.S. PATENT DOCUMENTS

| | | | | |
|---|---|---|---|---|
| 2,785,413 A | 7/1953 | Cook | ..... | 2/240 |
| 2,663,877 A * | 12/1953 | Bohman | ..... | A41B 11/002 2/239 |

(Continued)

FOREIGN PATENT DOCUMENTS

| | | | | |
|---|---|---|---|---|
| DE | 3803799 | 9/1988 | ..... | D06F 93/00 |
| DE | 202005010322 | 1/2006 | ..... | A41B 11/00 |

(Continued)

*Primary Examiner* — Khaled Annis
*Assistant Examiner* — Dakota Marin
(74) *Attorney, Agent, or Firm* — Christopher P. Maiorana, PC

(57) ABSTRACT

An apparatus includes a material, a first tag portion and a second tag portion. The material may be configured to be worn. The second tag portion may comprise a fastener. The first tag portion and the second tag portion may be attached near an opening of the material. When the material is worn, (a) the first tag portion may overlap the second tag portion and (b) the second tag portion may be between the first tag portion and the material. The fastener may be configured to removably attach to a complementary fastener on another of the apparatus.

17 Claims, 7 Drawing Sheets

(56) References Cited

U.S. PATENT DOCUMENTS 2,710,409 A * 6/1955 Burandt ..... A41D 19/0034 2/160
3,699,617 A 10/1972 Hofmeister ..... 24/81
4,058,853 A * 11/1977 Boxer ..... A41B 11/002 2/239
4,165,555 A * 8/1979 Boxer ..... A41B 11/002 209/937
4,624,060 A * 11/1986 Maxwell ..... A43D 999/00 24/704.2
5,038,413 A 8/1991 Ursino ..... 2/239
5,321,855 A 6/1994 Ciuffo ..... 2/239
5,483,704 A * 1/1996 Filipiak ..... A41F 13/00 2/239
5,579,541 A * 12/1996 Christy ..... A41B 11/002 2/239
5,740,558 A * 4/1998 Messman ..... A41B 11/002 2/239
5,918,318 A * 7/1999 Jones ..... A41B 11/002 2/160
5,926,925 A 7/1999 Hicks ..... 24/303
5,970,524 A * 10/1999 Becker ..... A41B 11/002 2/239
5,974,590 A 11/1999 Stubbs ..... 2/239
6,032,294 A * 3/2000 Dean ..... A41B 11/002 2/239
6,092,241 A * 7/2000 Bellet ..... A41B 11/002 2/239
6,185,751 B1 * 2/2001 Mason ..... A41B 11/002 2/239
6,237,158 B1 5/2001 Barbara ..... 2/239
6,279,169 B1 8/2001 Reichle ..... 2/239
6,374,420 B2 * 4/2002 Jossi ..... A41B 11/002 2/239
6,990,694 B2 1/2006 Poole ..... 2/239
7,058,986 B2 6/2006 Pietzyk-Hardy ..... 2/239
9,516,901 B2 12/2016 Schoenbeck et al.
D779,809 S 2/2017 Sorby et al.
2001/0018775 A1 9/2001 Jossi ..... 2/239
2007/0256280 A1 * 11/2007 Azan ..... A41B 11/002 24/90.1
2008/0034478 A1 * 2/2008 Patterson ..... A41B 11/002 2/239
2009/0293173 A1 * 12/2009 Gudzak ..... A41B 11/002 2/160
2012/0167276 A1 * 7/2012 Brosie ..... A41B 11/002 2/239
2012/0311768 A1 * 12/2012 Ladyzhenskaya ... A41B 11/002 2/239
2013/0302558 A1 * 11/2013 Schoenbeck ..... A41B 11/002 428/99
2014/0304895 A1 * 10/2014 Stuart ..... A41B 11/002 2/239
2015/0059060 A1 3/2015 Schoenbeck et al.
2015/0211174 A1 * 7/2015 Tan ..... D06F 95/008 2/69
2016/0138210 A1 * 5/2016 Frias Gomez ..... D06F 95/008 8/137
2016/0270453 A1 * 9/2016 Barrett ..... A41B 11/002
2016/0374404 A1 * 12/2016 Ramirez ..... A41B 11/002 2/239

FOREIGN PATENT DOCUMENTS

FR 2730391 2/1995 ..... A44B 21/00
FR 2858336 1/2003 ..... D06F 11/00

* cited by examiner

TAGS FOR TEMPORARILY CONNECTING TWO ITEMS

This application relates to U.S. Provisional Application No. 62/528,976, filed Jul. 6, 2017, which is hereby incorporated by reference in its entirety.

FIELD OF THE INVENTION

The invention relates to clothing generally and, more particularly, a method and/or apparatus for implementing tags for temporarily connecting two items.

BACKGROUND

Small clothing items, such as socks, are generally left loose among larger clothing items when washed. After being laundered, the clothing items are generally sorted, folded, and stored. For paired items such as socks, the sorting includes matching pairs together, older socks together and newer socks together, which is time consuming. Socks that are neatly folded and paired together in a drawer frequently become separated and disheveled when a person rummages through the drawer to retrieve another item. Commonly, one sock of a pair of socks becomes misplaced or lost. The misplacement of these clothing articles results in consumer costs by way of replacement expenses, time, and frustration. If socks are able to be paired right after wearing, then the disappearance of one of the pair of socks can be prevented and, therefore, reduce consumer costs and alleviate the tiresome task of sorting after laundering.

There are a number of methods which people have come up with in an effort to prevent losing one of the paired items, keeping paired items together during laundry, and managing storage of paired items.

U.S. Pat. No. 2,663,877 describes a fastener for keeping socks together. The fastener includes a small piece of tape, which is stitched or otherwise secured to a sock. A snap fastener or other connecter is affixed to the tape. In the alternative, the connector (usually a male to female type of connector) may be secured directly to the sock.

U.S. Pat. No. 2,785,413 describes a method for holding socks in pairs for laundering. Each sock includes a band, which encircles the cuff and is loosely secured thereto by a series of spaced loops, which extend over the band and are secured to the cuff of the sock. The loops may be embroidered on the socks after knitting, or formed during knitting. A retaining strip, including a plurality of loops, is adapted to encircle the bands and keep the socks together. The band additionally acts as a garter and a guide for folding the cuff.

U.S. Pat. No. 3,699,617 describes a connecting device for detachably joining together two articles of clothing for laundering, such as socks. The connecting device has two similar connecting members each of which is permanently attached to one garment. The connecting members each have a single stud or pair of studs at one end, which pierces one of the garments. Flanges at the opposite end of each member lock the studs in place after the member is folded to secure the garment. Attachment plugs are formed on each connecting member and are snapped together to retain the two garments.

U.S. Pat. No. 4,058,853 describes a securing method for keeping socks together. A pair of socks has a pair of fastener patches. The fastener patches are formed of a flexible material such as Velcro hook and pile (or hook and loop) fasteners. The patches may be sewn on to the socks, coated with a thermoplastic, and ironed on or glued on with epoxy cement. The hook patch may have a cover to prevent the patch from sticking to other clothing.

U.S. Pat. No. 4,165,555 describes a pair of flexible hook and pile strips for adhering each item of an article of clothing pair, such as socks, together.

U.S. Pat. No. 5,038,413 describes a sock-fastening device. The fastening device includes a pair of socks including a first sock and a second sock secured together by a snap-type fastening means. The snap-type fastening means includes a first fastener having a generally circular part that provides a projection and a second fastener having a generally circular part that provides a hole. When not joined to each other, each fastener may be adapted to receive a cover that provides a decorative appearance, and may be used to indicate that the two socks are a pair.

U.S. Pat. No. 5,321,855 describes a hook and loop fastening system for pairing socks, hosiery, and gloves.

U.S. Pat. No. 5,357,660 describes a sock pairing apparatus including a pair of similar sock clamp assemblies which include similar indicia.

U.S. Pat. No. 5,579,541 describes a fastener for keeping socks together. The fastener includes a sock having a tab attached along the edge of the sock. The tab and the sock have, on adjacent surfaces, a complementary arrangement of hook and pile patches. The patches can mate with each other so that the tab can be folded down when the sock is being worn and the tab can be mated to each other at other times.

U.S. Pat. No. 5,740,558 describes a device for attaching clothing articles together. The device includes a flexible strip stitched to the edge of each of a pair of socks. Each flexible strip includes a releasable fastening means such as a snap type fastener, which allows the two strips to be joined together.

U.S. Pat. No. 5,918,318 describes as attachment device for clothing items. The attachment device includes a pair of tabs formed from a strip of cloth or other material. Each tab includes a section of hook fastening elements and a section of loop fastening elements. The tabs can be folded over on themselves while the sock is being worn, and fastened to each other at other times.

U.S. Pat. No. 5,926,925 describes a magnetic socks holder.

U.S. Pat. No. 5,970,524 describes a pair of socks that may be joined together in a detachable fashion. The fastener may be a transparent snap having elements, which are woven, sewn, or pasted onto the leg portions of the respective socks. In the alternative, the snaps (which may also be hooks, or hook and loop Velcro fasteners) may be attached to straps that are knitted into the leg portion of the sock.

U.S. Pat. No. 5,974,590 describes a pair of socks including a connector adapted to attach the socks together. The connector includes first and second members that can be attached to each other on opposite sides of a region of sock fabric. The connectors may include regions that can be marked with indicia.

U.S. Pat. No. 6,032,294 describes a fastener for mating pairs of clothing items. Each fastener is a snap fastener having a male part, a female part, and two securing parts. Each securing part has a set of prongs, which extend through the material of a tab and the sock. The prongs deform to attach the securing part to the rim of the corresponding male or female part.

U.S. Pat. No. 6,092,241 describes a fastener for keeping a pair of socks together. The fastener includes a snap fastener, which may be received by a recess in a receptor plate. The snap fastener and receptor plate are each formed from a pair of plates that are attached to each other, through the sock, by a snap press fit. A flexible strap may attach the front and back of each of the plates.

U.S. Pat. No. 6,185,751 discloses releasably attachable socks in which the cuff of each sock is equipped with a male and a female snap fastener. The snap fasteners can be used to engage complementary snap fasteners on a second sock. Alternatively, the male and female snap fasteners on one sock can be fastened together when the cuff is folded over to conceal the fasteners from view.

U.S. Pat. No. 6,237,158 describes a clip assembly for matching socks to prevent the socks from being separated. The clip assembly includes a pair of dovetailed tongue and groove panels that can be joined by sliding the tongues on a first panel into the exterior surface of each sock by a pin that penetrates the sock fabric.

U.S. Pat. No. 6,279,169 describes a device for sorting and storing socks. The device includes male and female clamping elements that can be attached. The clamping elements include marks or other indicia to indicate ownership, color and original match.

U.S. Pat. No. 6,374,420 describes a fastener for fastening pairs of clothing items, such as socks, together. The fastener includes a first fastening element having at least one fastening projection in a center region, and a second fastening element having at least one opening for receiving the fastening projection. The projection of the first fastening element projects through a cut-out in a first textile label sewn to the first sock. The opening of the second fastening element also projects through a cut-out in a textile label sewn to the second sock.

U.S. Pat. No. 6,990,694 discloses a sock with first and second openings or channels positioned along the body of the sock. The openings or channels are sized sufficiently to allow a second sock to be threaded through the openings or channel and retained to the sock.

U.S. Pat. No. 7,058,986 describes a sock, which has a cuff with an inner fabric layer and an outer fabric layer folded over at a portion of the inner fabric layer. A snap fastener is secured to the inner fabric layer. A slit or opening extends through the outer fabric layer to expose the snap fastener so that the snap fastener can removably engage a complementary snap fastener on a second sock.

U.S. Pat. No. 9,516,901 describes a pair of complementary articles of clothing, such as socks, that can be detachably connected to each other. The detachable connection can be made by first and second complementary connecting elements, which are each fastened to the article of clothing by a carrier element. One of the ends of each carrier element forms a gripping area without a connecting function, so that the connection between the first and the second connecting element can be detached by pulling on the gripping areas of the carrier elements.

The aforementioned methods all have faults and limitations. One of the disadvantages of the preceding inventions is the difficulty of concealing the fastening mechanism from view when the clothing articles are being worn. Another disadvantage of the existing inventions is the direct contact of the skin of the wearer with the fastening device, which can cause skin irritation. A number of prior art methods and devices rely on hook and loop fasteners, hooks, pins, etc., which may snag, pull, or otherwise harm other fabrics. Those prior art devices and methods that rely on loose pieces for keeping paired article of clothing together require that the user not lose the pieces.

For the foregoing reasons, there exists a need to temporarily unite articles of clothing that overcomes the difficulties that have characterized the prior art.

It would be desirable to implement tags for temporarily connecting two items.

SUMMARY

The invention concerns an apparatus comprising a material, a first tag portion and a second tag portion. The material may be configured to be worn. The second tag portion may comprise a fastener. The first tag portion and the second tag portion may be attached near an opening of the material. When the material is worn, (a) the first tag portion may overlap the second tag portion and (b) the second tag portion may be between the first tag portion and the material. The fastener may be configured to removably attach to a complementary fastener on another of the apparatus.

BRIEF DESCRIPTION OF THE FIGURES

Embodiments of the invention will be apparent from the following detailed description and the appended claims and drawings in which:

DETAILED DESCRIPTION OF THE EMBODIMENTS

Embodiments of the present invention include providing articles of clothing that may (i) enable pairs of clothing articles to be removably connected to each other, (ii) implement complementary fasteners, (iii) keep articles of clothing together, (iv) temporarily unite articles of clothing, (v) be comfortable to wear, (vi) be implemented as a pair of socks and/or (vii) be aesthetically pleasing and/or economical to produce.

Figure 1:
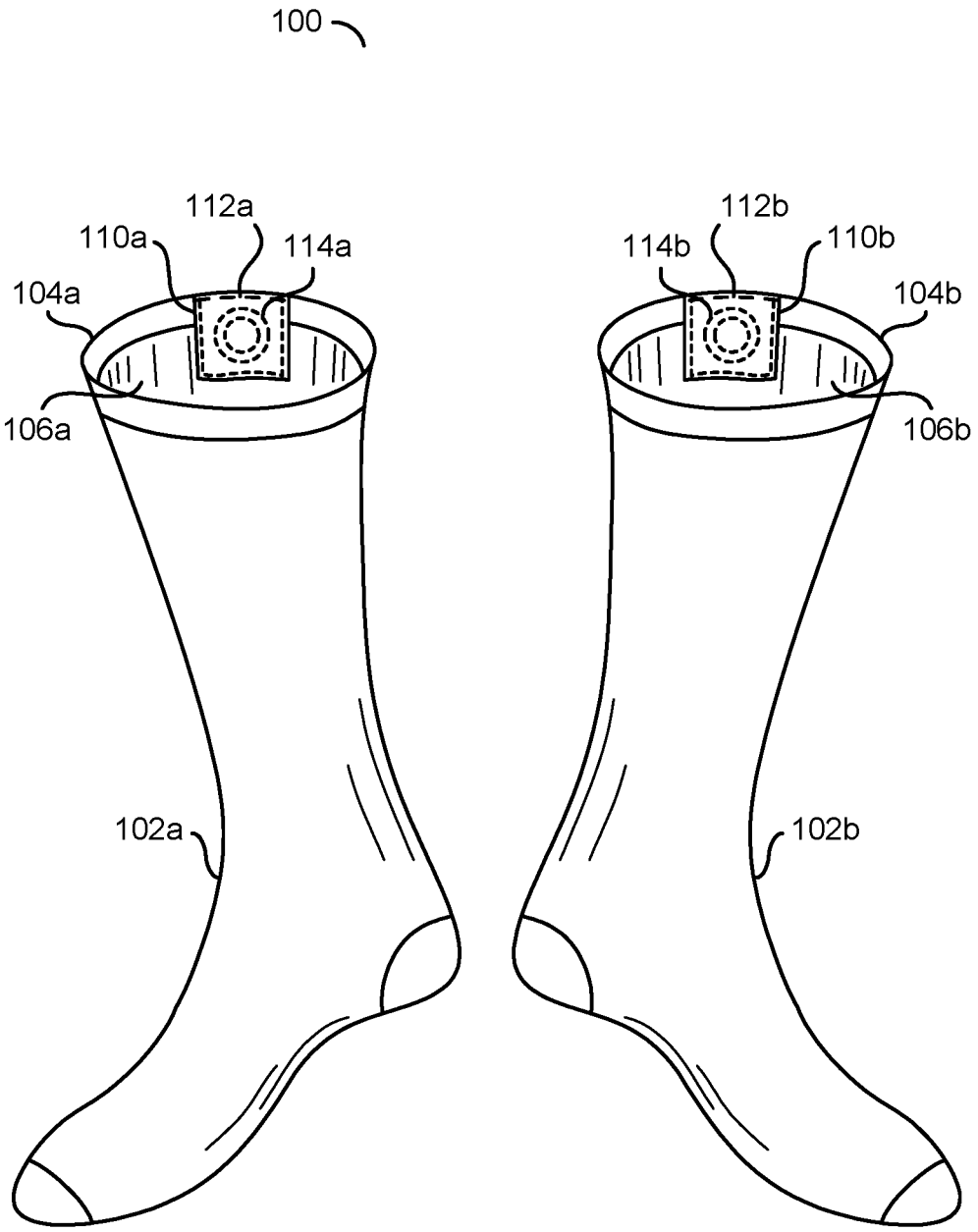
FIG. 1 is a diagram illustrating an example embodiment of the present invention.

Referring to FIG. 1, a diagram illustrating an example embodiment of the present invention is shown. The apparatus 100 is shown. The apparatus 100 may be a pair of articles of clothing. The pair of articles of clothing 100 may comprise two articles of clothing 102*a*-102*b*. In the example shown, the pair of articles of clothing 100 may be a pair of socks. The pair of socks 100 may comprise one sock 102*a* and another sock 102*b*.

Each of the socks 102*a*-102*b* may comprise a material configured to be worn. The material of each of the socks 102*a*-102*b* may comprise a respective opening 104*a*-104*b*. Material of the inner surfaces 106*a*-106*b* is shown (e.g., visible through the opening). For example, the inner surfaces 106*a*-106*b* may be the portion of the socks 102*a*-102*b* that come into contact with the body of the wearer.

At, or near, the openings 104*a*-104*b* of the socks 102*a*-102*n*, two tags (or tag portions) 110*a*-110*b* and 112*a*-112*b* may be implemented (e.g., the sock 102*a* may comprise the tag 110*a* and the tag 112*a* and the sock 102*b* may comprise the tag 110*b* and the tag 112*b*). In an example, the two tags 110*a*-110*b* and the tags 112*a*-112*b* may be small tags attached (e.g., stitched) to one portion of the inner surface material 106*a*-106*b* (e.g., the top edge) of the socks 102*a*-102*b*. The tags 110*a*-110*b* may implement a top (or outer) tag for the respective socks 102*a*-102*b*. The tags 112*a*-112*b* may implement a bottom (or inner) tag for the respective socks 102*a*-102*b*. The tags 110*a*-110*b* and/or the tags 112*a*-112*b* may be implemented using a resilient yet comfortable fabric material. The material used, the size and/or the location of the tags 110*a*-110*b* and/or the tags 112*a*-112*b* may be varied according to the design criteria of a particular implementation.

In some embodiments, the tag portions 110*a*-110*b* may be separate from the tag portions 112*a*-112*b*. In some embodiments, the tag portions 110*a*-110*b* and the tag portions 112*a*-112*b* may be one tag folded in half with the two ends attached (e.g., stitched) to the inside materials 106*a*-106*b* of the socks 102*a*-102*b* (to be described in more detail in association with FIGS. 8-9). In some embodiments, the tags 110*a*-110*b* and the tags 112*a*-112*b* may be the same size. In some embodiments, the tags 110*a*-110*b* and the tags 112*a*-112*b* may be different sizes. Generally, the tags 110*a*-110*b* may be large enough to cover and/or overlap the tags 112*a*-112*b* (as shown). In some embodiments, the tags 110*a*-110*b* and the tags 112*a*-112*b* may be made of the same material. In some embodiments, the tags 110*a*-110*b* and the tags 112*a*-112*b* may be made of different materials. The placement and/or position of the tags 110*a*-110*b* and/or the tags 112*a*-112*b* on the socks 102*a*-102*b* may be varied according to the design criteria of a particular implementation. Generally, the tags 110*a*-110*b* and the tags 112*a*-112*b* may be positioned on the inner-leg side material 106*a*-106*b* of each of the socks 102*a*-102*b* (e.g., the medial side of leg or ankle).

Fasteners 114*a*-114*b* are shown. The fasteners 114*a*-114*b* may be complementary fasteners. The fastener 114*a* may be on the sock 102*a* (e.g., a male connector) and the fastener 114*b* may be the complementary fastener (e.g., a female connector) on the sock 102*b*. For example, the pair of fasteners 114*a*-114*b* may be snap button type fasteners. The fasteners 114*a*-114*b* may enable the socks 102*a*-102*b* to be removably attached to each other. For example, the fastener 114*a* may snap into the fastener 114*b* to make the socks 102*a*-102*b* a mated pair of socks. Generally, the fasteners 114*a*-114*b* may be implemented using a type of connector that may provide a secure attachment (e.g., secure enough to remain attached during the agitating caused by a washing machine). Mating the pair of socks 100 may ensure that the socks 102*a*-102*b* are not separated, lost and/or misplaced during storage, laundering and/or sorting. The type of fasteners 114*a*-114*b* implemented may be varied according to the design criteria of a particular implementation.

The fasteners 114*a*-114*b* may be attached to a respective one of the tags 112*a*-112*b*. For example, the fastener 114*a* may be a male connector and implemented on the tag 112*a* and the fastener 114*b* may be a female connector and implemented on the tag 112*b*. In another example, the fastener 114*a* may be a female connector and implemented on the tag 112*a* and the fastener 114*b* may be a male connector and implemented on the tag 112*b*. The tags 110*a*-110*b* may overlap the tags 112*a*-112*b*. Overlapping the tags 112*a*-112*b* using the tags 110*a*-110*b* may cover the fasteners 114*a*-114*b*. In the example shown, the fasteners 114*a*-114*b* are hidden from view by the tags 110*a*-110*b*.

Figure 2:
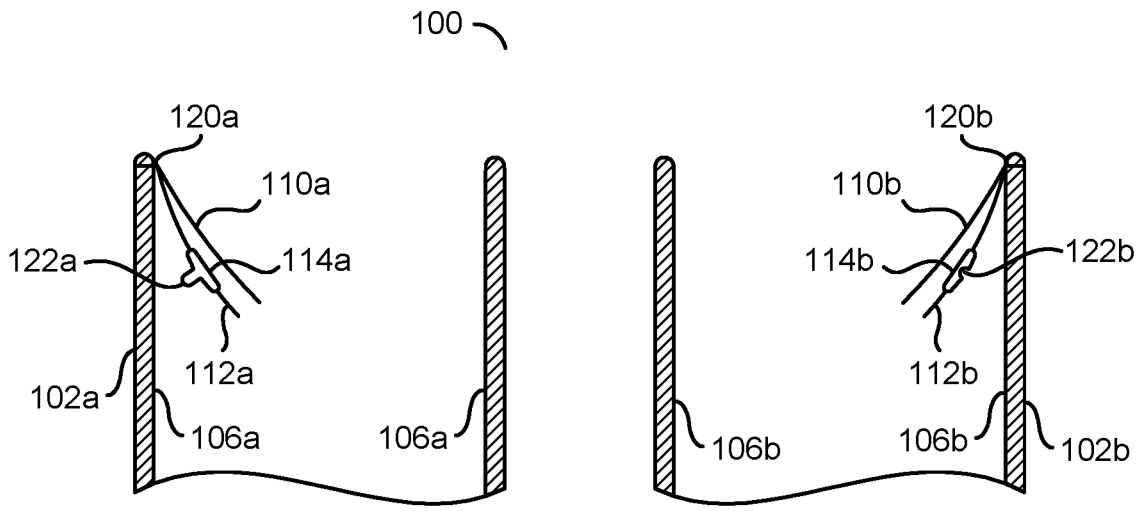
FIG. 2 is diagram illustrating a side, cross-sectional view of the upper portions of the sock pair with the tags in a flipped down position.

Referring to FIG. 2, a diagram illustrating a side, cross-sectional view of the upper portions of the sock pair 100 with the tags in a flipped down position is shown. The socks 102*a*-102*b* are shown. The tag 110*a* and the tag 112*a* are shown attached the sock 102*a* at an attachment point 120*a*. Similarly, the tag 110*b* and the tag 112*b* are shown attached the sock 102*b* at an attachment point 120*b*. The attachment points 120*a*-120*b* may be a location where the tags 110*a*-110*b* and/or the tags 112*a*-112*b* are affixed (e.g., stitched) to the respective socks 102*a*-102*b*. In the example shown, the attachment points 120*a*-120*b* are shown on the inner surface materials 106*a*-106*b* of the socks 102*a*-102*b* near the openings 104*a*-104*b*. The location of the attachment points 120*a*-120*b* may be varied according to the design criteria of a particular implementation.

The fasteners 114*a*-114*b* are shown attached to the tags 112*a*-112*b*. For example, the tags 112*a*-112*b* are shown on one side of the tags 112*a*-112*b* (e.g., facing away from the outer tag 110*a*). The fastener 114*a* may comprise a male connector 122*a*. The fastener 114*b* may comprise a female connector 122*b*. The male connector 122*a* and the female connector 122*b* may enable the fasteners 114*a*-114*b* to mate. Mating the fasteners 114*a*-114*b* may connect the socks 102*a*-102*b*.

In the example shown, the tags 110*a*-110*b* and the tags 112*a*-112*b* are in a flipped down position (e.g., as shown in association with FIG. 1). In the flipped down position, the tags 110*a*-110*b* may overlap the tags 112*a*-112*b*. For example, the tags 110*a*-110*b* may cover the tags 112*a*-112*b*. In the flipped down position, the tags 110*a*-110*b* may hide the tags 112*a*-112*b* and the fasteners 114*a*-114*b* between the top tags 110*a*-110*b* and the inner surface material 106*a*-106*b* of the socks 102*a*-102*b*.

Generally, the tags 110*a*-110*b* and the tags 112*a*-112*b* may be in the flipped down position when the inner material 106*a*-106*b* is worn. During wear, the tags 110*a*-110*b* and the tags 112*a*-112*b* may be folded inside of the openings 104*a*-104*b* and tucked flat and out of sight inside the socks 102*a*-102*b*. The tags 110*a*-110*b* and/or the tags 112*a*-112*b* may be positioned between the inner surface material 106*a*-106*b* of the socks 102*a*-102*b* and the body (e.g., legs/ankles) of the wearer. The stud part 122*a* (e.g., the male connector) of the snap button fastener 114*a* and the socket part 122*b* (e.g., the female connector) of the snap button fastener 114*b* may be facing and/or pointing away from the legs/ankles of the wearer when the socks 102*a*-102*b* are being worn. The top tag portions 110*a*-110*b* may act as a barrier between the fasteners 114*a*-114*b* and the body of the wearer. For example, the tags 110*a*-110*b* may be made of a soft material that may protect the body of the user from feeling the uncomfortable and/or cold metal of the fasteners 114*a*-114*b*.

Figure 3:
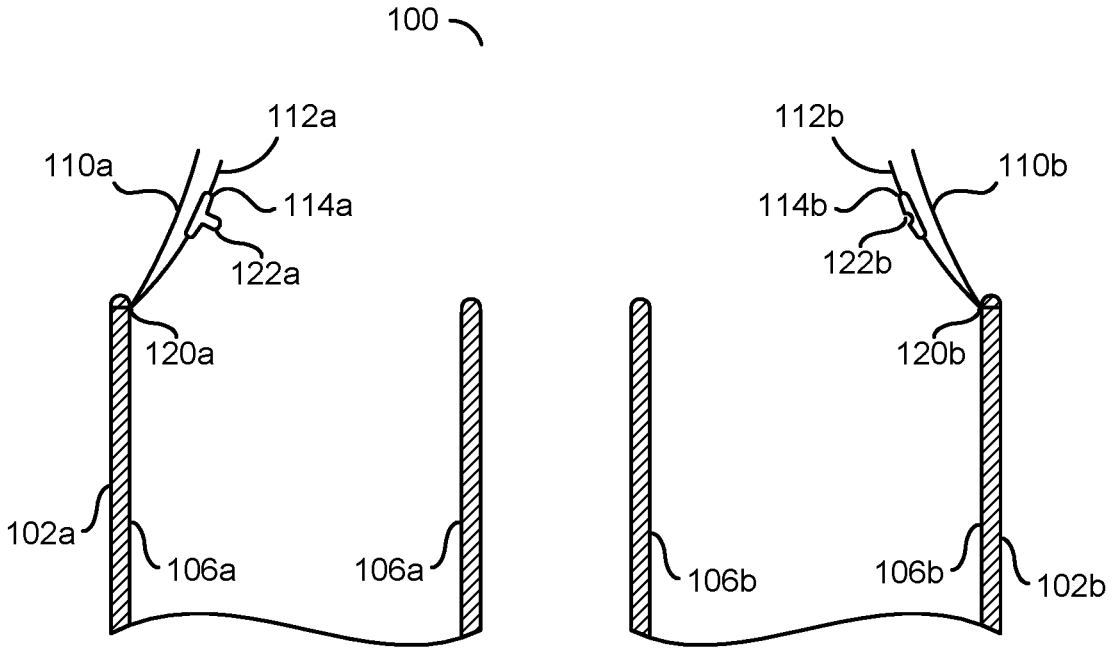
FIG. 3 is a diagram illustrating a side, cross-sectional view of the upper portions of the sock pair with the tags in a flipped up position.

Referring to FIG. 3, a diagram illustrating a side, cross-sectional view of the upper portions of the sock pair 100 with the tags in a flipped up position is shown. The socks 102*a*-102*b* are shown. The tag 110*a* and the tag 112*a* are shown attached the sock 102*a* at the attachment point 120*a*. Similarly, the tag 110*b* and the tag 112*b* are shown attached the sock 102*b* at the attachment point 120*b*.

In the example shown, the tags 110*a*-110*b* and the tags 112*a*-112*b* are in a flipped up position. In the flipped up position, the tags 110*a*-110*b* may be visible (e.g., not hidden within the socks 102*a*-102*b*). For example, the visible side (or surface) of the tags 110*a*-110*b* may be implemented with a decorative image, a logo and/or a mark (e.g., for branding). In the flipped up position, the fasteners 114*a*-114*b* may be exposed. By exposing the fasteners 114*a*-114*b*, the two fasteners 114*a*-114*b* may be in a position to connect the socks 102*a*-102*b*.

In the example shown, only one edge of each of the tags 110*a*-110*b* and the tags 112*a*-112*b* may be stitched to the socks 102*a*-102*b* at the respective attachment points 120*a*-120*b*. Since the tags 110*a*-110*b* and the tags 112*a*-112*b* may be stitched at one edge, the free ends of the tags can be folded towards and over the stitched ends 120*a*-120*b* so that the pair of complementary fasteners 114*a*-114*b* may be detachably connected to one another when desired (e.g., when the pair of socks 100 are not being worn). By stitching the tags 110*a*-110*b* and the tags 112*a*-112*b* at the attachment points 120*a*-120*b*, the tags 110*a*-110*b* and the tags 112*a*-112*b* may be easily flipped up (e.g., for attaching the sock pair 100) and flipped down (e.g., while worn).

Figure 4:
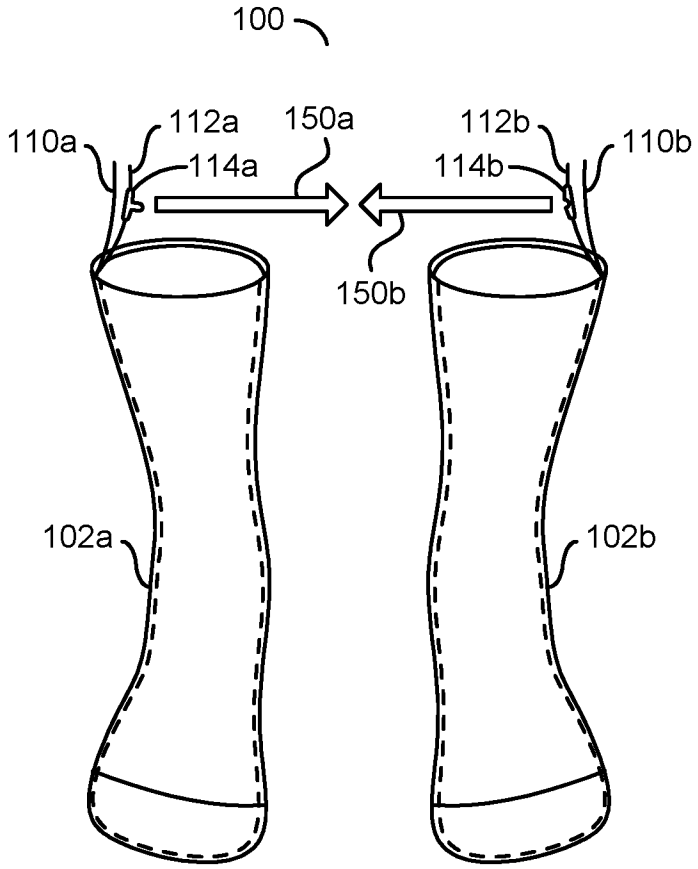
FIG. 4 is a diagram illustrating the sock pair with the tags in the flipped up position so that the pair of complementary fasteners are oriented to be detachably connected to one another.

Referring to FIG. 4, a diagram illustrating the sock pair 100 with the tags 110*a*-110*b* and the tags 112*a*-112*b* in the flipped up position so that the pair of complementary fasteners 114*a*-114*b* are oriented to be detachably connected to one another is shown. When the tags 110*a*-110*b* and the tags 112*a*-112*b* are in the flipped up position, the fasteners 114*a*-114*b* may be connected. Arrows 150*a*-150*b* are shown. The arrows 150*a*-150*b* may represent connecting the fastener 114*a* of the sock 102*a* to the fastener 114*b* of the sock 102*b*.

To attach the pair of socks 100 to one another so that the sock 102*a* and the sock 102*b* may stay together, the user may grab and fold (e.g., raise to the flipped up position) both the tag 110*a* and 112*a* of the sock 102*a* over (e.g., above a level of) the attachment point 120*a* (e.g., the stitching) in one hand and grab and fold (e.g., raise to the flipped up position) both the tag 110*b* and 112*b* of the sock 102*b* over the attachment point 120*b* (e.g., the stitching) in the other hand. Next, the user may push the fasteners 114*a*-114*b* held in opposite facing alignment with one another (e.g., as shown in FIG. 4) towards one another (as shown by the arrows 150*a*-150*b*) until the fasteners 114*a*-114*b* are detachably connected to one another. For example, the pair of socks 100 may be attached when the male connector 122*a* and the female connector 122*b* are mated.

Figure 5:
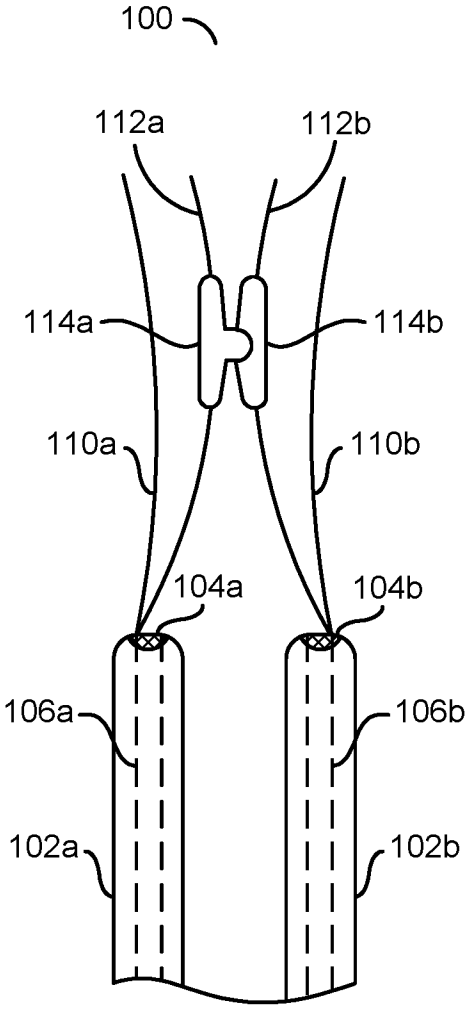
FIG. 5 is a diagram illustrating the pair of socks attached together using the pair of complementary fasteners.

Referring to FIG. 5, a diagram illustrating the pair of socks 100 attached together using the pair of complementary fasteners 114*a*-114*b* are shown. The socks 102*a*-102*b* are shown folded (e.g., relatively flat with small openings 104*a*-104*b*) and paired together. The tags 110*a*-110*b* and the tags 112*a*-112*b* are shown in the flipped up position. The fasteners 114*a*-114*b* are shown mated together to create the secured attachment.

To separate the pair of socks 100 so that the sock 102*a* and the sock 102*b* are independent from each other, the user may grab the tag 110*a* and the tag 112*a* in one hand and the tag 110*b* and the tag 112*b* in the other hand and pull apart (e.g., opposite to the direction of the arrows 150*a*-150*b* shown in association with FIG. 4). Pulling apart with sufficient force may cause the pair of complementary snap button fasteners 114*a*-114*b* to be detached from one another (e.g., the male connector 122*a* may pull out from the female connector 122*b*).

The fasteners 114*a*-114*b* may be implemented as part of the tag portions 112*a*-112*b* (e.g., the fasteners 114*a*-114*b* may not be attached directly to the fabric of the socks 102*a*-102*b*). By implementing the fasteners 114*a*-114*b* on tags 112*a*-112*b* and not directly onto the material of the socks (e.g., on the inner surface material 106*a*-106*b*), damage to the fabric may be prevented. For example, if the fasteners 114*a*-114*b* were attached directly to the fabric of the socks 102*a*-102*b*, the fabric may become damaged (e.g., stretched and/or torn) during the attachment and/or detachment processes. Implementing the fasteners as part of the tags 112*a*-112*b*, any stress to material caused by attaching and/or detaching the fasteners 114*a*-114*b* may be applied to the material of the tags 112*a*-112*b* and not the material of the socks 102*a*-102*b*.

Figure 6:
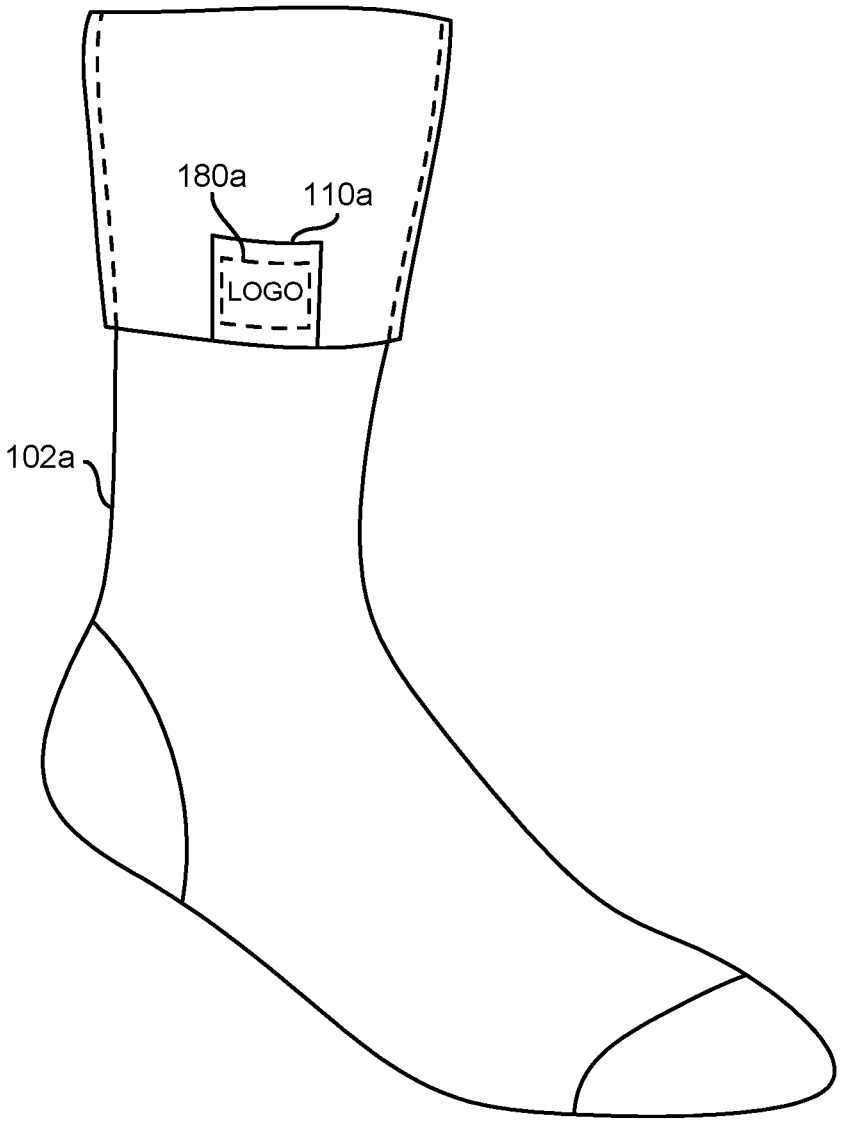
FIG. 6 is a diagram illustrating one sock of the pair of socks with the upper portion folded down.

Referring to FIG. 6, a diagram illustrating one sock 102*a* of the pair of socks 100 with the upper portion of the sock 102*a* folded down is shown. The outer tags 110*a*-110*b* may also function as a space for branding. A design 180*a* is shown on the outer tag 110*a*. In an example, the design 180*a* may be an image, a mark and/or a logo. The design 180*a* may be used to help with marketing. Similarly, the tag 110*b* may have a design 180*b* (not shown). In the example shown, the top portion of the sock 102*a* may be folded over to form a cuff. When the socks 102*a*-102*b* are folded over when worn, the outer tags 110*a*-110*b* may be exposed/visible and the design 180*a*-180*b* may also be visible.

Figure 7:
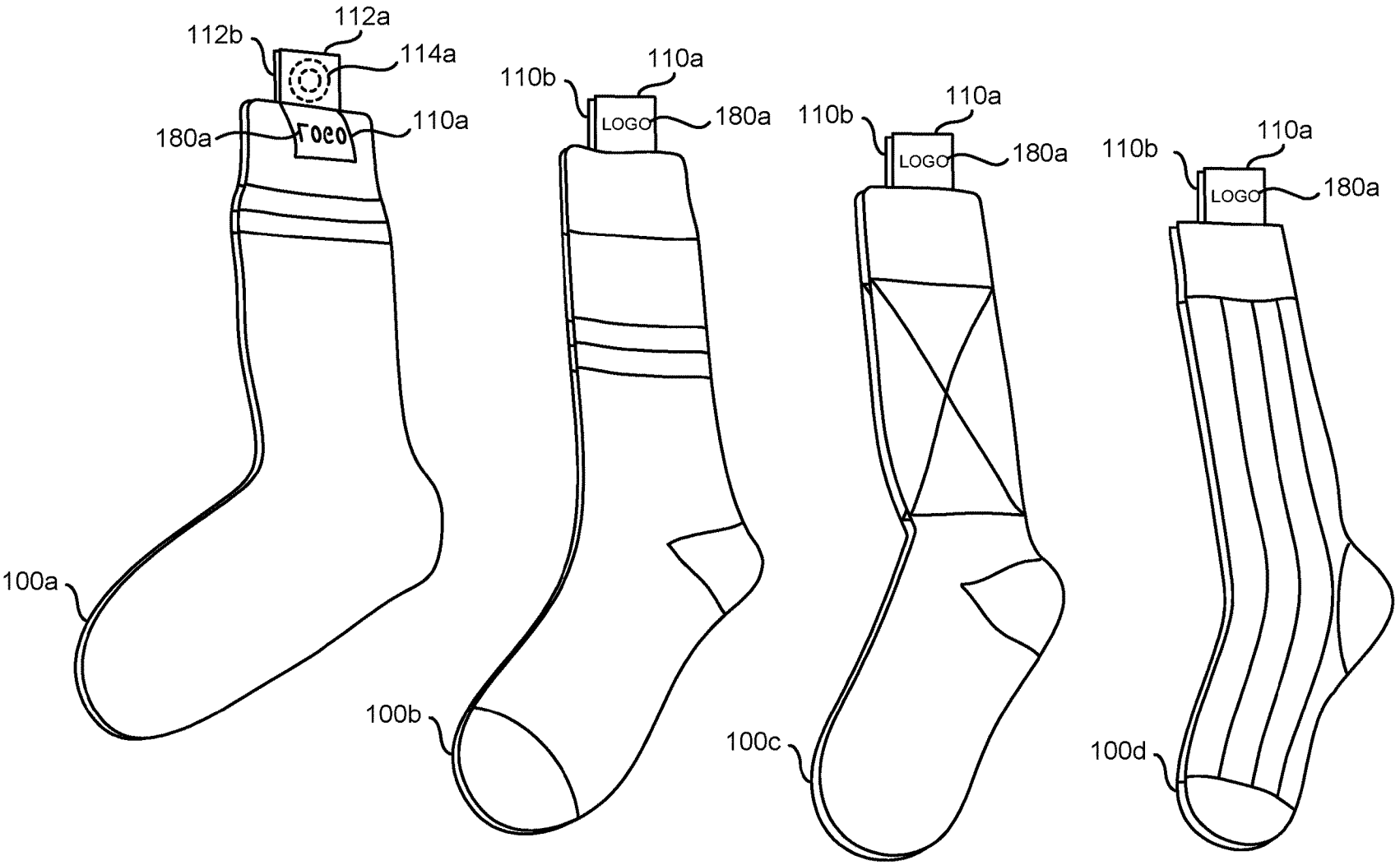
FIG. 7 is a diagram illustrating pairs of socks removably attached using the complementary fasteners.

Referring to FIG. 7, a diagram illustrating pairs of socks removably attached using the complementary fasteners is shown. Four pairs of socks 100*a*-100*d* are shown. The pairs of socks 100*a*-100*d* may each be an attached pair (e.g., each comprising respective socks 102*a*-102*b* attached together by the fasteners 114*a*-114*b*). Each of the pairs of socks 100*a*-100*d* may comprise two socks 102*a*-102*b* having the same pattern (e.g., matching socks). Attaching the socks 102*a*-102*b* may enable like socks to be kept together when not worn.

The pair of socks 100*a* is shown with the inner tags 112*a*-112*b* in the flipped up position and the outer tag 110*a* in the flipped down position. The inner tags 112*a*-112*b* of the pair of socks 100*a* may be in the flipped up position to enable the fasteners 114*a*-114*b* to securely attach to each other. In the example shown, the backside of outer tag 110*a* of the pair of socks 100*a* is shown folded back outside of the sock (e.g., the back stitching of the logo 180*a* may be visible).

The pair of socks 100*b*-100*d* are shown with the inner tags 112*a*-112*b* and the outer tags 110*a*-110*b* in the flipped up position (e.g., as described in accordance with FIGS. 3-5). With the outer tags 110*a*-110*b* flipped up for the pairs of socks 100*b*-100*d*, the designs 180*a*-180*b* may be visible. For example, the pairs of socks 100*a*-100*d* may be put on a merchandise display for sale in a store and the design logos 180*a*-180*b* may be visible to attract customers. In some embodiments, when the tags 112*a*-112*b* are in the flipped up position, the connection between the fasteners 114*a*-114*b* may provide a support for hanging the pair of socks 100*a*-100*b* on a display. For example, a merchandise display may have a rod for storing and/or displaying merchandise and the connection between the fasteners 114*a*-114*b* may provide a support to hang the pairs of socks 100*a*-100*d* on the rod (e.g., the rod may be inserted underneath the fasteners 114*a*-114*b* and above the openings 104*a*-104*b* of each of the pairs of socks to enable the pairs of socks 100*a*-100*d* to slide off the rod). Furthermore, the tags 110*a*-110*b* may provide an advertisement for the brand by exposing the designs 180*a*-180*b* while the pairs of socks 100*a*-100*b* are hung on the merchandise display rod.

Figure 8:
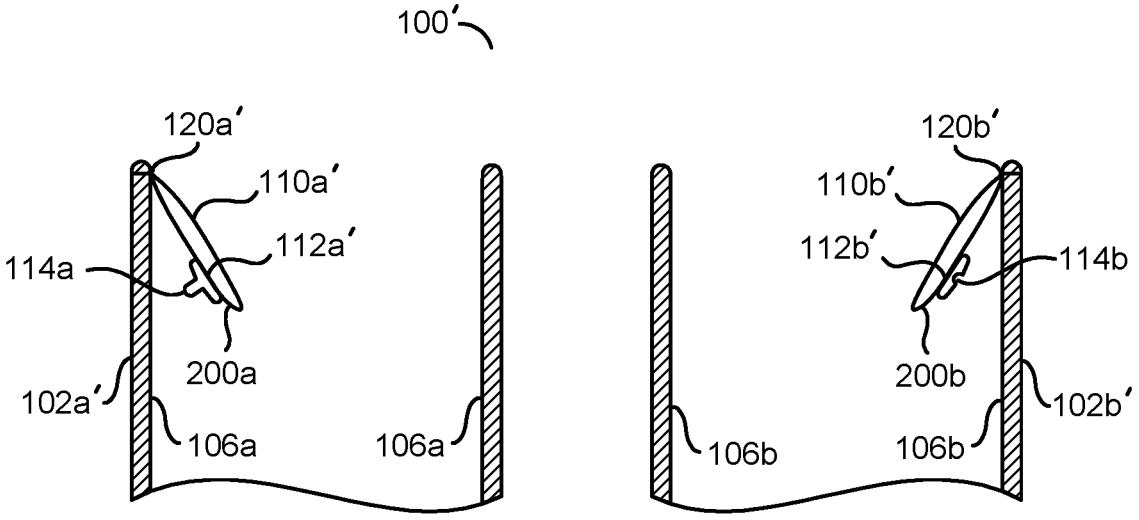
FIG. 8 is a diagram illustrating a side, cross-sectional view of the upper portions of the sock pair implementing a folded tag embodiment in a flipped down position.

Referring to FIG. 8, a diagram illustrating a side, cross-sectional view of the upper portions of the sock pair 100' implementing a folded tag embodiment in a flipped down position is shown. The socks 102*a*'-102*b*' are shown. The tag portion 110*a*' and the tag portion 112*a*' are shown attached the sock 102*a*' at the attachment point 120*a*'. Similarly, the tag portion 110*b*' and the tag portion 112*b*' are shown attached the sock 102*b*' at the attachment point 120*b*'.

The tag portions 110*a*'-110*b*' and the tag portions 112*a*'-112*b*' are shown as a folded embodiment. In the folded embodiment, the tag portion 110*a*' and the tag portion 112*a*' may be implemented as one piece. The single piece of material comprising the tag portion 110*a* and the tag portion 112*b* may have a fold 200*a*. The single piece of material may extend as the tag portion 110*a*' and then fold back at the fold 200*a* and the single piece of material may be folded under the tag portion 110*a*' to extend back to the sock 102*a*' as the tag portion 112*a*'. For example, the tag portion 110*a*' and the tag portion 112*a*' may form a loop of material. Both of the tag portion 110*a*' and the tag portion 112*a*' may have one end attached (e.g., stitched) to the attachment point 120*a*'. For example, a first end of the tag portion 110*a*' may be stitched to the attachment point 120*a*' and a second end of the tag portion 110*a*' may be the fold 200*a*, and a first end of the tag portion 112*a*' may be the fold 200*a* and the second end of the tag portion 112*a*' may be stitched to the attachment point 120*a*'. The tag portion 110*b*', the fold 200*b* and the tag portion 112*b*' may have a similar implementation.

The tag portions 110*a*'-110*b*' and the tag portions 112*a*'-112*b*' are shown in the flipped down position. In the flipped down position, the fasteners 114*a*-114*b* may be on the tag portions 112*a*'-112*b*' folded under the tag portions 110*a*'-110*b*'. With the tags 112*a*'-112*b*' folded under the tag portions 110*a*'-110*b*' in the flipped down position, the fasteners 114*a*-114*b* may be separated from the skin of the user by the barrier created by the tag portions 110*a*'-110*b*'.

The tag portions 110*a*'-110*b*' may be implemented to reduce discomfort that may be caused by the fasteners 114*a*-114*b* rubbing against the skin of the wearer. When the socks 102*a*'-102*b*' are worn, the tag portions 112*a*'-112*b*' may be in the flipped down position to orient the connectors 122*a*-122*b* facing the inner surface 106*a*-106*b* of the socks 102*a*'-102*b*' (e.g., away from the skin of the wearer) to prevent the connectors from causing discomfort (e.g., the male connector 122*a* may press against the skin of the wearer causing discomfort if the tag portion 112*a*' is not flipped down). For example, the backside of the fasteners 114*a*-114*b* may be relatively flat to reduce, avoid and/or limit discomfort. Additionally, the outer tag portions 110*a*'-110*b*' may function as a barrier to prevent direct contact between the skin of the wearer and the fasteners 114*a*-114*b* during wear. Since the tag portions 110*a*'-110*b*' and the tag portions 112*a*'-112*b*' may be connected at the respective folds (or stitched portions) 200*a*-200*b*, the tag portion 110*a*' and the tag portion 112*a*' and the tag portion 110*b*' and the tag portion 112*b*' may each be flipped down together.

Figure 9:
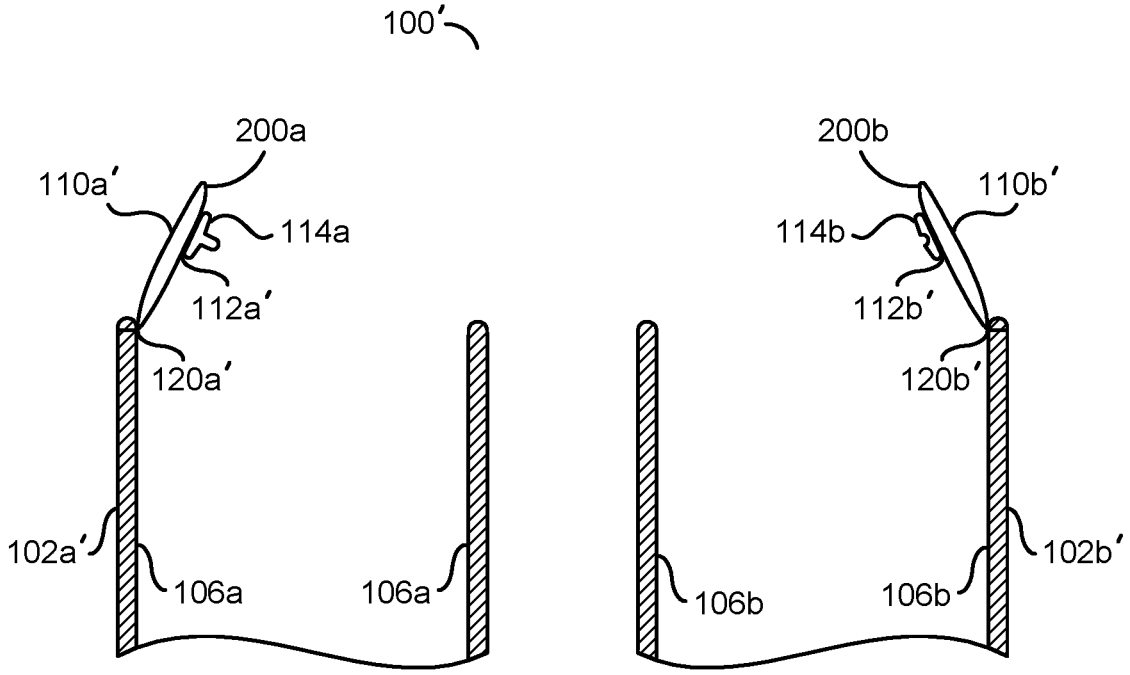
FIG. 9 is a diagram illustrating a side, cross-sectional view of the upper portions of the sock pair implementing a folded tag embodiment in a flipped up position.

Referring to FIG. 9, a diagram illustrating a side, cross-sectional view of the upper portions of the sock pair 100' implementing a folded tag embodiment in a flipped up position is shown. The socks 102*a*'-102*b*' are shown. The tag portion 110*a'* and the tag portion 112*a*' are shown attached the sock 102*a*' at the attachment point 120*a*' and folded (or stitched together) at the end 200*a*. Similarly, the tag portion 110*b*' and the tag portion 112*b*' are shown attached the sock 102*b*' at the attachment point 120*b*' and folded (or stitched together) at the end 200*b*. In some embodiments, the tag portions 110*a*'-110*b*' may be the same material as the tag portions 112*a*'-112*b*' (e.g., one continuous piece of fabric that may be folded to form a loop and/or one continuous tag). In some embodiments, the tag portions 110*a*'-110*b*' may be a different material from the tag portions 112*a*'-112*b*' (e.g., two separate pieces of fabric that may be stitched together at the ends 200*a*-200*b*). The type of material used for the tag portions 110*a*'-110*b*' and/or the tag portions 112*a*'-112*b*' may be varied according to the design criteria of a particular implementation.

The tag portions 110*a*'-110*b*' and the tag portions 112*a*'-112*b*' are shown in the flipped up position. In the flipped up position, the fasteners 114*a*-114*b* may be on the tag portions 112*a*'-112*b*' folded under the tag portions 110*a*'-110*b*'. With the tags 112*a*'-112*b*' folded under the tag portions 110*a*'-110*b*' in the flipped up position, the fasteners 114*a*-114*b* may be exposed and facing each other to enable the socks 102*a*'-102*b*' to be removably attached to each other.

Figure 10:
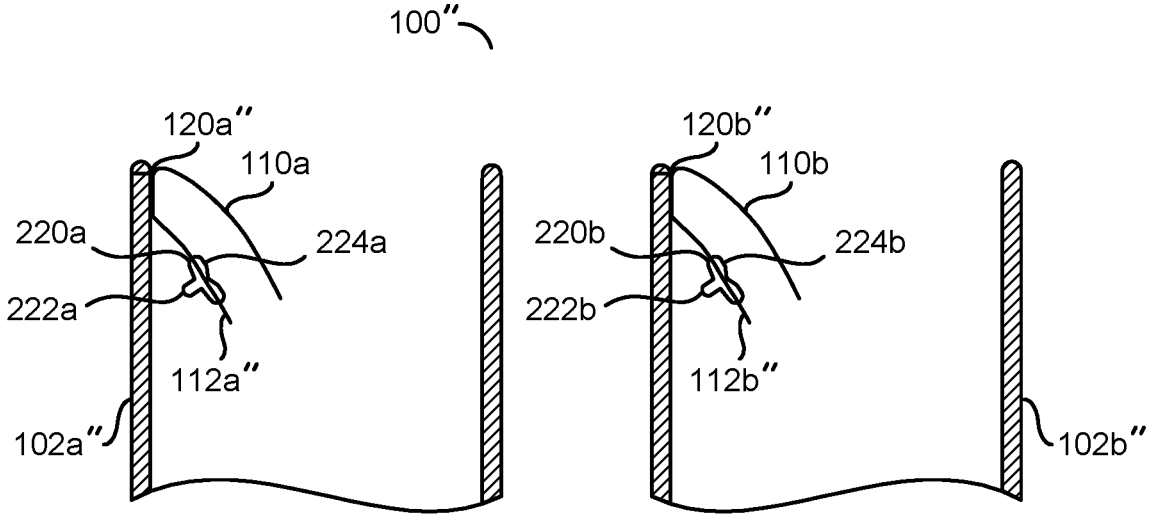
FIG. 10 is a diagram illustrating a side, cross-sectional view of the upper portions of the sock pair implementing a male-female fastener in a flipped down position.

Referring to FIG. 10, a diagram illustrating a side, cross-sectional view of the upper portions of the sock pair 100" implementing a male-female fastener in a flipped down position is shown. The socks 102*a*"-102*b*" are shown. The tag portion 110*a* and the tag portion 112*a*" are shown attached the sock 102*a*" at the attachment point 120*a*". Similarly, the tag portion 110*b* and the tag portion 112*b*" are shown attached the sock 102*b*" at the attachment point 120*b*".

The tag portion 112*a*" may comprise the male-female fastener 220*a*. The male-female fastener 220*a* may comprise a male connector 222*a* on one side (or surface) of the tag portion 112*a*" and a female connector 224*a* on the other side (or surface) of the tag portion 112*a*". The tag portion 112*b*" may comprise the male-female fastener 220*b*. The male-female fastener 220*b* may comprise a male connector 222*b* on one side of the tag portion 112*b*" and a female connector 224*b* on the other side of the tag portion 112*b*". The sock 102*b*" may have the same implementation as the sock 102*a*".

The tag portions 110*a*-110*b* and the tag portions 112*a*"-112*b*" are shown in the flipped down position. In the flipped down position, the fasteners 220*a*-220*b* may be on the tag portions 112*a*"-112*b*" folded under the tag portions 110*a*-110*b*. With the tags 112*a*"-112*b*" folded under the tag portions 110*a*-110*b* in the flipped down position, the fasteners 220*a*-220*b* may be separated from the skin of the user by the barrier created by the tag portions 110*a*-110*b*. The male connectors 222*a*-222*b* may be pressed against the sock 102*a*"-102*b*" when worn to prevent, avoid and/or limit discomfort. The female connectors 224*a*-224*b* may be relatively flat (e.g., may not cause discomfort). The tag portions 110*a*-110*b* may provide a barrier between the female connector 224*a*-224*b* and the skin of the user to prevent, avoid and/or limit discomfort.

Figure 11:
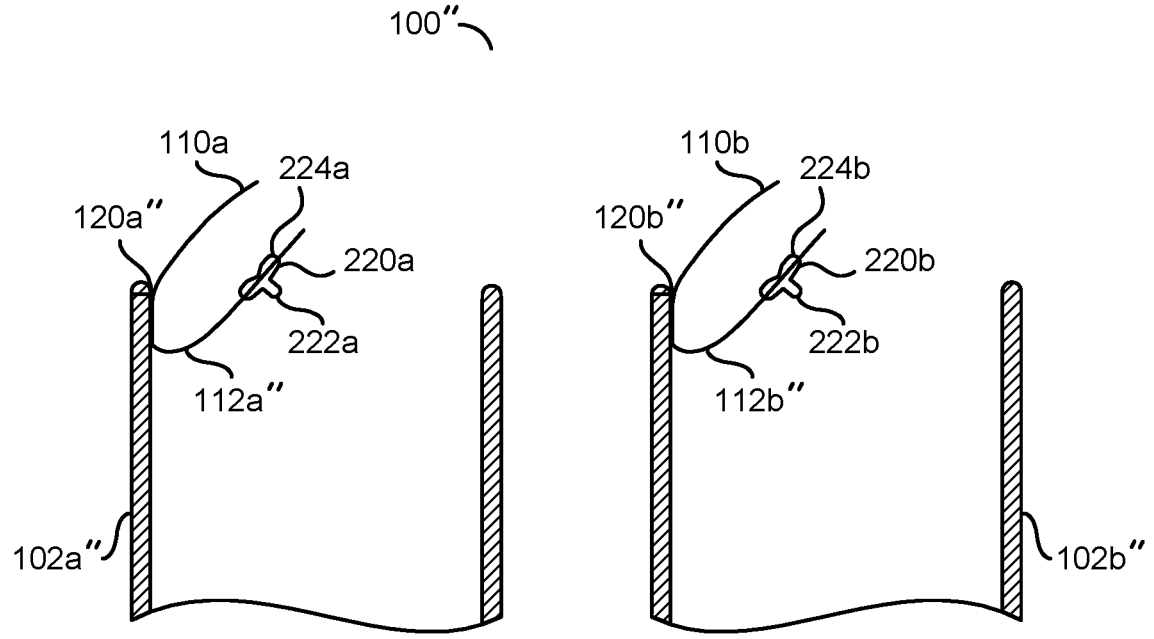
FIG. 11 is a diagram illustrating a side, cross-sectional view of the upper portions of the sock pair implementing a male-female fastener in a flipped up position.

Referring to FIG. 11, a diagram illustrating a side, cross-sectional view of the upper portions of the sock pair 100" implementing a male-female fastener in a flipped up position is shown. The socks 102*a*"-102*b*" are shown. The tag portion 110*a* and the tag portion 112*a*" with the fastener 220*a* are shown attached the sock 102*a*" at the attachment point 120*a*". Similarly, the tag portion 110*b* and the tag portion 112*b*" with the fastener 220*b* are shown attached the sock 102*b*" at the attachment point 120*b*".

The tag portions 110*a*-110*b* and the tag portions 112*a*"-112*b*" are shown in the flipped up position. In the flipped up position, the fasteners 220*a*-220*b* may be on the tag portions 112*a*"-112*b*" under the tag portions 110*a*-110*b*. With the tags 112*a*"-112*b*" and the tag portions 110*a*-110*b* in the flipped up position, the fasteners 220*a*-220*b* may be exposed. When the fasteners 220*a*-220*b* are exposed, the male connector 222*a* of the sock 102*a* may be facing the female connector 224*b* of the sock 102*b*. The socks 102*a*"-102*b*" may be removably attached by connecting the male connector 222*a* of the sock 102*a*" to the female connector 224*b* of the sock 102*b*". For example, the tag portion 110*b* may be folded back over the attachment point 120*b*" to be out of the way of the connection between the male-female fasteners 220*a*-220*b*.

Implementing the male-female fasteners 220*a*-220*b* may enable each of the socks 102*a*"-102*b*" to be the same. Since each of the socks 102*a*"-102*b*" each has a male connector and a female connector, the socks 102*a*"-102*b*" may be removably attached to each other. Since each of the socks 102*a*"-102*b*" may be the same, a manufacturing process may be simplified (e.g., only one design is used instead of separate designs for a sock with a male connector and a sock with a female connector). For the wearer, even if one of the socks 102*a*"-102*b*" is lost or damaged, one sock may be easily replaced (e.g., socks may be mixed and matched with any other sock that implements the male-female fasteners 220*a*-220*b*).

In some embodiments, the pair of clothing articles 100 may comprise other types of clothing and/or protective gear. In an example, the pair of clothing articles 100 may be a pair of gloves. In another example, the pair of clothing articles 100 may implement protective gear (e.g., sports equipment such as elbow pads, shin guards, hockey socks, wrist guards, knee pads, etc.). In yet another example, the pair of articles of clothing 100 may comprise injury prevention and/or rehabilitation equipment (e.g., knee braces, elbow braces, wrist braces, etc.). In some embodiments, the pair of articles of clothing 100 may comprise items that are not the same but often used together. For example, the pair of articles of clothing 100 may comprise a ski mask and scarf. The type of articles of clothing may be varied according to the design criteria of a particular implementation.

The apparatus 100 may be configured to attach paired articles of clothing 102*a*-102*b*, such as socks, together. The apparatus 100 may utilize paired fasteners 114*a*-114*b* on each of the two articles of clothing 102*a*-102*b*. The paired fasteners 114*a*-114*b* may be configured to enable the two articles of clothing 102*a*-102*b* to be attached together. The apparatus 100 may be configured to temporarily unite the articles of clothing 102*a*-102*b* and may be aesthetically pleasing, economical to produce, comfortable and safe to use and/or highly reliable in operation.

In some embodiments, the apparatus 100 may comprise a pair of socks 102*a*-102*b* with a pair of complementary snap button type fasteners 114*a*-114*b*. The fasteners 114*a*-114*b* may be connected to one another so that one of the socks (e.g., 102*a*) may be attached to the other one of the socks (e.g., 102*b*). At or near the opening 104*a*-104*b* of each of the socks 102*a*-102*b* of the pair 100, two small tags 110*a*-110*b* and 112*a*-112*b* made out of resilient yet comfortable fabric material may be are attached (e.g., stitched). For example, on one edge (e.g., a top edge) of the tags 110*a*-110*b* and/or 112*a*-112*b* may be attached to the inside material 106*a*-106*b* of each sock 102*a*-102*b*. One of the tags (e.g., the tags 110*a*-110*b*) may be on top of the other tags (e.g., the tags 112*a*-112*b*).

The pair of complementary snap button fasteners 114*a*-114*b* may be placed onto each of the inner tags 112*a*-112*b* between the sock material 106*a*-106*b* and the outer tags 110*a*-110*b* so that when the tags (e.g., both the tags 110*a*-110*b* and the tags 112*a*-112*b*) are folded up and over the openings 104*a*-104*b* of the respective socks 102*a*-102*b*, the fasteners 114*a*-114*b* are clear to engage and keep the pair of socks 100 together (e.g., during laundry, sorting, storage, etc.). The tags 110*a*-110*b* and/or the tags 112*a*-112*b* may be tucked between the material of the socks 106*a*-106*b* and skin (e.g., the legs) of the wearer so that the tags 110*a*-110*b* and/or the tags 112*a*-112*b* are hidden from view during wear.

The outer tags 110*a*-110*b* may function as a barrier between the skin of the wearer and the securing buttons 114*a*-114*b* on the inner tags 112*a*-112*b* during wear. The outer tags 110*a*-110*b* may also function as a space for branding in the form of the designs 180*a*-180*b* (e.g., a logo and/or a mark). Since branding is such an important aspect of marketing, the outer tags 110*a*-110*b* may be configured to enable the logo 180*a*-180*b* to be displayed either when the socks 102*a*-102*b* are worn and/or when the socks 102*a*-102*b* are attached together (e.g., hung on display in a store). When the tags 110*a*-110*b* and/or the tags 112*a*-112*b* are folded up and over the opening 104*a*-104*b* of the socks 102*a*-102*b*, the fasteners 114*a*-114*b* may be clear to engage and keep the pair of socks 100 together once the fasteners 114*a*-114*b* are engaged. The fasteners 114*a*-114*b* may be detachably connected to one another to keep the pair of socks 100 together (e.g., during laundering and/or storage).

The terms "may" and "generally" when used herein in conjunction with "is(are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

While the invention has been particularly shown and described with reference to embodiments thereof, it will be understood by those skilled in the art that various changes in form and details may be made without departing from the scope of the invention.

The invention claimed is:

1. An apparatus comprising:

a material having an inner surface and a top edge surrounding an opening, said material configured to be worn;

a first tag portion having a first end connected to said top edge and a second end;

a second tag portion having a first end connected to said top edge and a second end; and a fastener connected to said second tag portion near said second end of said second tag portion, wherein in a first configuration, (a) said first tag portion overlaps said second tag portion, (b) said second tag portion is between said first tag portion and said material, (c) said first tag portion overlaps said second tag portion to cover said fastener, and (d) said fastener points towards said inner surface of said material, and in a second configuration, said second tag portion is extended from said top edge such that said fastener is configured to removably attach to a complementary fastener.

2. The apparatus according to claim 1, wherein said material is implemented as a sock.

3. The apparatus according to claim 1, wherein (i) said first tag portion and said second tag portion are formed from a single tag and (ii) said first tag portion and said second tag portion are separated by a fold.

4. The apparatus according to claim 3, wherein (i) said second tag portion folds under said first tag portion and (ii) said first tag portion forms a barrier configured to be between a body of a wearer and said second tag portion when said apparatus is worn.

5. The apparatus according to claim 1, wherein when said apparatus is worn, said first tag portion and said second tag portion are folded inside said opening and configured to be tucked between said material and a body of a wearer.

6. The apparatus according to claim 1, wherein said fastener implements a male connector and said complementary fastener implements a female connector.

7. The apparatus according to claim 1, wherein said fastener implements a female connector and said complementary fastener implements a male connector.

8. The apparatus according to claim 1, wherein removably attaching said apparatus to another of said apparatus enables (i) said apparatuses to be separated for wearing and (ii) said apparatuses to be held together as a pair.

9. The apparatus according to claim 1, wherein said fastener comprises a male connector on a first side of said second tag portion and a female connector on a second side of said second tag portion.

10. The apparatus according to claim 1, wherein said first tag portion comprises a logo.

11. The apparatus according to claim 1, wherein said fastener implements a snap button.

12. A pair of articles of clothing comprising:

a first article of clothing comprising (a) a first tag and (b) a second tag; and a second article of clothing comprising (a) a third tag and (b) a fourth tag, wherein (i) said second tag includes a first fastener and said fourth tag includes a second fastener, (ii) said first tag and said second tag are attached near an opening of said first article of clothing, (iii) said third tag and said fourth tag are attached near an opening of said second article of clothing, (iv) in a first configuration, (a) said first tag overlaps said second tag, (b) said third tag overlaps said fourth tag to cover said second fastener, (c) said second tag is between said first tag and said first article of clothing and (d) said fourth tag is between said third tag and said second article of clothing and (v) in a second configuration, said first fastener is configured to removably attach to said second fastener.

13. The pair of articles of clothing according to claim 12, wherein when said first article of clothing and said second article of clothing are worn, (i) said first tag and said second tag are folded inside said opening of said first article of clothing and configured to be tucked between said first article of clothing and a body of a wearer and (ii) said third tag and said fourth tag are folded inside said opening of said second article of clothing and configured to be tucked between said second article of clothing and said body of said wearer.

14. The pair of articles of clothing according to claim 12, wherein (i) said first tag is configured as a barrier between a body of a wearer and said second tag and (ii) said third tag is configured as said barrier between said body of said wearer and said fourth tag.

15. The pair of articles of clothing according to claim 12, wherein removably attaching said first fastener and said second fastener (i) enables said pair of articles of clothing to be separated for wearing and (ii) prevents one of said first article of clothing and said second article of clothing from being lost.

16. The pair of articles of clothing according to claim 12, wherein said first fastener implements a male connector and said second fastener implements a female connector.

17. The pair of articles of clothing according to claim 12, wherein said first article of clothing and said second article of clothing each implement a sock.

* * * * *